US009249948B2

(12) United States Patent
Darwinkel et al.

(10) Patent No.: US 9,249,948 B2
(45) Date of Patent: Feb. 2, 2016

(54) SHAVING OR HAIR TRIMMING DEVICE

(71) Applicant: KONINKLIJKE PHILIPS N.V., Eindhoven (NL)

(72) Inventors: Geert-Jan Darwinkel, Eindhoven (NL); Marcus Conrelis Petrelli, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/429,022

(22) PCT Filed: Jan. 16, 2014

(86) PCT No.: PCT/IB2014/058324
§ 371 (c)(1),
(2) Date: Mar. 18, 2015

(87) PCT Pub. No.: WO2014/115066
PCT Pub. Date: Jul. 31, 2014

(65) Prior Publication Data

US 2015/0338060 A1 Nov. 26, 2015

(30) Foreign Application Priority Data

Jan. 28, 2013 (EP) ..... 13152848
Apr. 11, 2013 (EP) ..... 13163282

(51) Int. Cl.
*B26B 21/46* (2006.01)
*F21V 7/04* (2006.01)
*B26B 19/46* (2006.01)
*F21V 33/00* (2006.01)
*F21Y 101/02* (2006.01)
*F21W 131/30* (2006.01)

(52) U.S. Cl.
CPC . *F21V 7/04* (2013.01); *B26B 19/46* (2013.01); *F21V 33/004* (2013.01); *F21W 2131/30* (2013.01); *F21Y 2101/02* (2013.01)

(58) Field of Classification Search
CPC ..... B26B 19/04; B26B 19/14
See application file for complete search history.

(56) References Cited

U.S. PATENT DOCUMENTS

| | | | |
|---|---|---|---|
| 2,279,341 | A | 4/1942 | Powell |
| 4,094,062 | A | 6/1978 | Papanikolaou |
| 4,473,943 | A | 10/1984 | Papanikolaou |
| 5,743,214 | A | 4/1998 | McClain |
| 6,915,576 | B2 | 7/2005 | Brzezinski |

FOREIGN PATENT DOCUMENTS

| | | | |
|---|---|---|---|
| DE | 9402875 | U1 | 4/1994 |
| EP | 2040893 | B1 | 10/2010 |
| GB | 519717 | A | 4/1940 |
| WO | 2007044461 | A1 | 4/2007 |
| WO | 2008010153 | A1 | 1/2008 |
| WO | 2013027136 | A1 | 2/2013 |

*Primary Examiner* — Elmito Breval

(57) ABSTRACT

A device for projecting an elongate optical image (7) onto a surface (5) is disclosed. The device has an optical element (8) with a reflective surface (11) configured to reflect a beam of light emitted by a light source (9) so that the beam of light (12) converges in a first plane (X-Y) and diverges in a second plane (Y-Z), the first plane being at right angles to the second plane.

15 Claims, 7 Drawing Sheets

SHAVING OR HAIR TRIMMING DEVICE

This application is the U.S. National Phase application under 35 U.S.C. §371 of International Application No. PCT/IB2014/058324, filed on Jan. 16, 2014, which claims the benefit of European Application No. 13152848.1 filed on Jan. 28, 2013 and European Application No. 13163282.0 filed on Apr. 11, 2013. These applications are hereby incorporated by reference herein.

FIELD OF THE INVENTION

This invention relates to a shaving or hair trimming device comprising an optical element for projecting an elongate optical image onto the skin of a user.

BACKGROUND OF THE INVENTION

EP2040893B1 discloses a shaver having a light source which projects an image, such as a line segment onto a user's skin during use of the shaver. The line segment is configured to indicate the position of the edge of the razor blade to allow the user to judge the extent of the shaving action and position the shaver appropriately. The shaver has a light source which projects a line segment either directly onto the skin or onto a reflective surface which reflects the line towards the skin of the user.

With devices such as those known from EP204893B1, the line segment may suffer from poor definition and focus as it is difficult to collimate the light beam into a concentrated line projection that extends for any significant length.

Typically, when an optical line is generated, parts of the line furthest from the light source will have a lower intensity and therefore a lower visibility than parts of the line closest to the light source. Therefore, the parts of the line furthest from the light source will be less visible to a user.

Furthermore, when projecting an optical line against skin, for example for use with a shaver, the intensity of the light emitted is subject to safety regulations. Light may interact with the skin or the eyes and cause irritation or damage. Regulations stipulate a limited light intensity to ensure that these risks are minimal. However, because the line will have variable intensity along its length, as previously explained, the power of the light source has to be increased to achieve sufficient visibility in the parts of the line furthest from the light source. However, this also increases the intensity of the light in the other parts of the optical line, which may cause problems in the parts of the line closest to the light source. It is also important to ensure that the intensity of the light is not so high that it could cause irritation or injury in the event that it is inadvertently deflected away from its desired optical path which may occur, for example, if the shaver is damaged.

SUMMARY OF THE INVENTION

It is an object of the invention to provide a shaving or hair trimming device for projecting an elongate image onto a user's skin which substantially alleviates or overcomes the problem of poor image definition and focus and to provide a more concentrated image.

It is also an object of the invention, to provide a shaving or hair trimming device that generates an image of more uniform intensity.

Some embodiments of the invention may only provide an image having greater definition, focus and a more concentrated image, whereas other embodiments go a step further and additionally provide the image with a more uniform intensity as well.

According to the present invention, there is provided a shaving or hair trimming device comprising an optical element for projecting an elongate optical image onto a user's skin, the optical element comprising a reflective surface configured to reflect a beam of light emitted by a light source so that the beam of light converges in a first plane and diverges in a second plane, the first plane being at right angles to the second plane.

The reflective surface causes the light to converge towards a focal point in one direction, while the light diverges in another, perpendicular direction. This configuration generates an elongate projection on the surface, such as a line. The reflective surface may be configured such that the focal point is located on or close to the surface, such that the projected image is focussed on the surface and is most visible.

The reflective surface may be curved in said first plane, or otherwise shaped or configured, to cause the beam of light to converge. The curvature of the surface will define the convergence of the light beam that is reflected.

The reflective surface may extend with constant curvature along second plane, from said first plane. The curvature of the reflective surface is constant across the reflective surface so that all of the light that is incident on the reflective surface is directed in the same direction and has the same focal length.

The reflective surface may be configured to reflect an elliptical beam of light emitted by said light source and wherein a major axis of said elliptical beam of light extends in the same direction as the elongate image. An elliptical beam already has an elongate shape and is easy to manipulate into the elongate projection.

The device may further comprise a light source integrally formed with the optical element and the reflective surface may be an internal surface of the optical element. An integrally formed optical element and light source is advantageous because the special arrangement of the light source and optical element would be fixed and therefore the combined unit would have a constant and predictable output. This is important for consistency of performance and also for meeting regulatory requirements.

The beam of light may exit the optical element, towards said nearby surface, via a face of the optical element, said face being configured to refract the beam of light such that the beam of light diverges further in the second plane. Alternatively, the face may be flat.

The face may comprise a concave depression configured to refract the beam of light to deliver a more uniform light intensity distribution in the second plane. The light is refracted as it passes through the interface between the optical element and the air. By shaping the face to control the refraction, more light can be directed towards the ends of the image to increase the light intensity in these regions and reduce the light intensity in the centre.

In addition to controlling intensity, the face through which the light exits the optical element may result in further divergence of the light, and therefore further elongation of the projected image, also due refraction of the beam as it leaves the medium of the optical element and enters the air surrounding the device. However, elongation of the line may also be achieved using a face which is flat and by controlling the angle of incidence of the light through the face.

In another embodiment, the reflective surface may comprise a reflective portion and at least one absorptive portion configured to reflect a higher proportion of low intensity light which is incident on the reflective surface compared to high intensity light, such that the reflected light has a more uniform intensity.

The parts of the reflective surface that reflect light can be configured to reflect a lower proportion of the intense light and a higher proportion of the less intense light. In this way, the intensity of the reflected light, which is projected to the surface to form the elongate image, will be evened out and may be substantially uniform.

The reflective portion may have a variable surface area, such that a higher proportion of light is reflected from a part of the reflective portion with larger surface area and a smaller proportion of light is reflected from a part of the reflective surface with smaller surface area.

The variable surface area causes a higher proportion of light to be reflected where the surface area is larger, which may correspond to the position where the light has a lower intensity. Contrarily, the part of the reflective surface with a smaller surface area may be positioned to align with the region of higher light intensity. In this way, less high intensity light from the light source is projected towards the surface, which will improve the intensity distribution along the elongate image.

In preferred embodiments, the light source, which may be a diode, is integral with the optical element to form an optical module. By integrating the diode into one element, the optical element is more cost-effective and takes up less space within the appliance. It also decreases the risk of creating a potentially hazardous collimating beam in the event of failure or misuse of the device.

The device may comprise a housing having a handle, in which case, the optical element can be retractable into the housing when not in use. By making the device so that the optical element is retractable, the overall size of the device can be minimised when it is not being used.

The device may also comprise a cutting element and an adjuster to adjust the angle of the beam of light relative to the cutting element. This enables the position of the beam to be controlled very precisely by the user, so that it can be positioned just above the cutting element for ease of use and optimum alignment.

According to another aspect of the present invention, there is provided a method of projecting an elongate image onto the skin of a user in a shaving or hair trimming device comprising an optical element, said method comprising directing a beam of light emitted by a light source into said optical element such that the beam of light converges in a first plane and diverges in a second plane, the first plane being at right angles to the second plane.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1A:
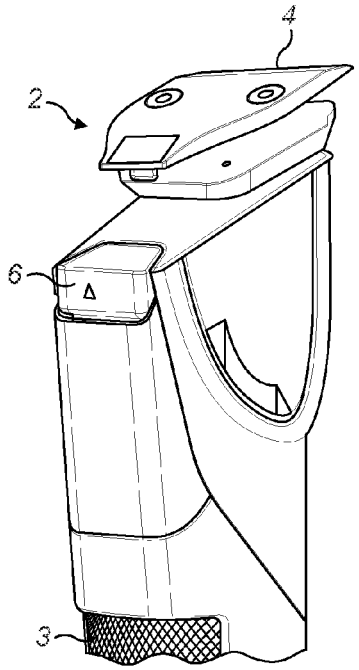
FIG. 1*a* shows a hair trimming device comprising an optical module for projecting an elongate optical image onto the skin of a user, with the optical module in a stowed position.
Figure 1B:
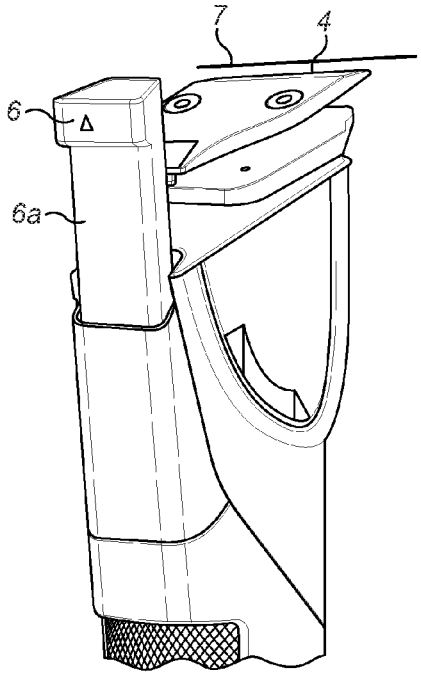
FIG. 1*b* shows the hair trimming device of FIG. 1*a* with the optical module in an extended position ready for use.

FIGS. 1*a* and 1*b* show a hair trimmer device 1 with a cutting head 2 and a handle or housing 3. The cutting head 2 comprises a plurality of blades 4 and a user can move the cutting head 2 over the surface of their skin 5 to cut hair. The cutting head 2 also comprises an optical module 6, which projects a line 7 (see FIG. 1B) onto the skin 5 of a user. The line 7 is projected either during use, to indicate the position of the blades 4 on the skin, and/or immediately before use, to indicate the position of the blades 4 should the trimmer be pressed against the skin 5. It is useful for a user to know the position of the blades 4 so that they know the extent to which hairs on the skin 5 will be cut when using the trimmer 1. As described in more detail below, the optical module 6 may be retracted into the housing 3 of the device when not in use, as shown in FIG. 1A, and moved into a position ready for use, as shown in FIG. 1B. More specifically, the optical module may be mounted on a post 6*a* that is slideably received within the housing 3.

The projected optical line 7 may be aligned with and extend parallel to the blade 7, as shown in FIG. 1. Alternatively, the projected optical line may be perpendicular to the direction of the blade 7 and be aligned with the ends of the blade 7, to indicate the width of the cutting area, as shown in later embodiments.

Figure 2:
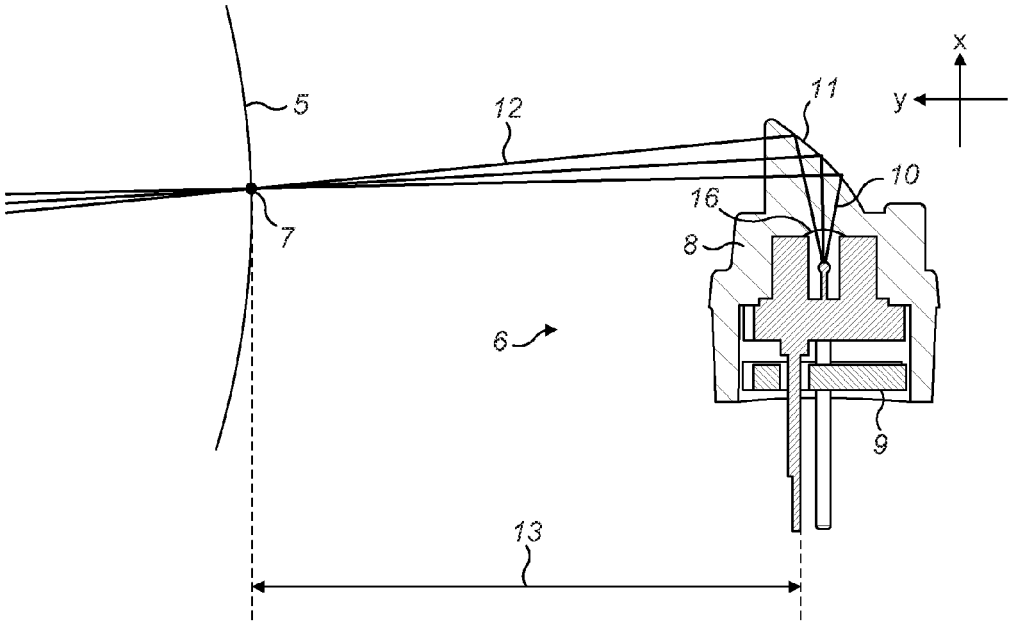
FIG. 2 shows a side view of an optical module used in the hair trimming device of FIG. 1, for projecting an elongate optical image.

The optical module 6 is shown in FIG. 2 and includes a light source 9 and an optical element 8. The light source 9 may be any of a light emitting diode, a laser, a halogen bulb or a luminescent bulb, although preferably the light source 9 is a laser diode which generates light in the visible red spectrum. Red light contrasts well against the skin 5 of a user and a red line has an inherently clear meaning. Although, it will be appreciated that other colours are also suitable and may be achieved by use of a specific light source and/or filter. The operating power of the light source may be in the region of 5 mW, with a wavelength of between 500 to 700 nm.

It will be appreciated that the light source 9 and the optical element 8 may together form a unitary, integrated component that is sealed during manufacture to form the optical module 6.

The optical element 8 is made of a transparent or translucent material such as a polymer, and the shape of the optical element 8 is configured to project an optical line 7 towards the skin of a user, using light from the light source 9. The optical element 8 may be translucent and coloured, to act as a filter to determine the colour of the projected line 7.

Figure 3:
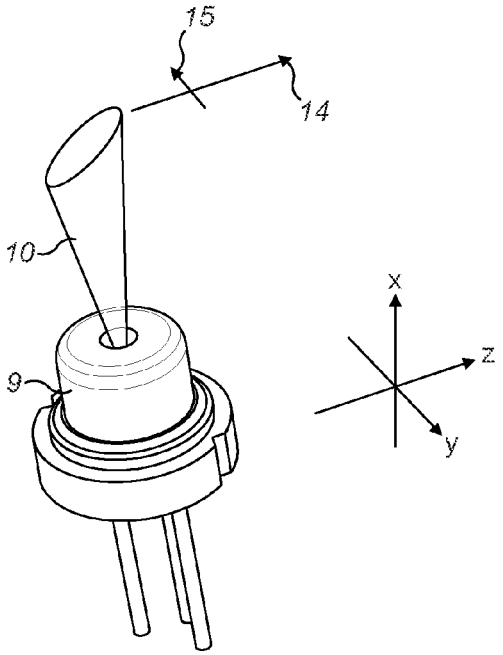
FIG. 3 shows the light source used in the optical module of FIG. 2.

The light source 9 is configured to generate an elliptical shaped beam 10, as shown in FIGS. 2 and 3. An elliptical shaped beam 10 is preferred because, to project a line, a beam must be elongated in one direction and focussed in another direction. An elliptical beam is already larger in one direction than the other so it is more easily manipulated to generate a line projection. Although it will be appreciated that the light source may generate a circular beam, or a beam of some other shape, and in this case the optical element should be configured to manipulate the beam into a projected optical line, as required.

As mentioned above, the light source 9 may be integrated within the optical element 8 to form the optical module 6, with the optical element 8 being moulded around the light source 9. In an alternate embodiment, the light source 9 may be positioned adjacent and perpendicular to the optical element 8 so that the light beam 10 from the light source 9 enters the optical element 8.

Figure 4:
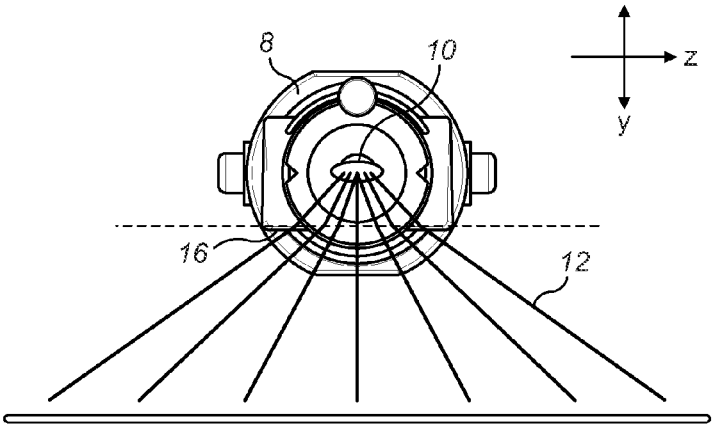
FIG. 4 shows a top view of the optical module of FIG. 2.

FIG. 2 shows a side view of the optical module 6 for projecting an optical line 7, the view being in the plane defined by the axes X and Y. FIG. 4 shows a top view of the device for projecting an optical line 7 in the plane defined by the axes Y and Z. Axes X, Y and Z are perpendicular to each other, as shown in FIGS. 3 and 4.

As shown in FIG. 2, the light beam 10 from the light source 9 enters the optical element 8 and is reflected by a reflective surface 11. The reflective surface 11 is configured to reflect the light beam 10 towards the skin 5 of a user in such a way as the reflected light 12 forms a line 7 which is projected onto the skin so that the line extends in the direction of axis Z (see FIG. 4).

The reflective surface 11 is configured to manipulate the light beam 10 such that, as the reflected light 12 moves towards the skin 5, the reflected light 12 converges in the direction of the X axis and diverges in the direction of the Z axis, to form an elongate line.

In particular, the reflected light 12 converges in the direction of the X axis towards a focal point at a defined focal length 13, as shown in FIG. 2. The focal length 13 is set to match the distance between the optical device 6 and the skin 5 during use of the device and in this way, the light 12 is focussed on the skin 5 and the optical line 7 is most defined and visible. As shown in FIG. 4, the reflected light 12 is divergent in the direction of the Z axis so that the projected optical line 7 is elongated to the desired length.

The reflected light 12 may travel towards the skin along the Y axis, in a direction which is perpendicular to the direction of the X and Z axes. However, it will be appreciated that the reflective surface 11 may be configured to reflect the light 12 in another direction towards the skin, depending on the position and orientation of the optical device 6 relative to the skin 5 and the required position of the projected optical line 7.

The desired length of the projected optical line 7 in the direction of the Z axis may be less than, equal to or more than the width of the shaver head 2 (see FIG. 1). Preferably, the optical line 7 is longer than the width of the shaver head so that the optical line 7 is visible even when the shaver head is pressed against the skin of a user during use.

The focal length 13 of the device should be set to match the distance between the device 6 and the skin of the user during use, or immediately before use when the trimmer is close to, but not pressed against the user's skin.

As explained, the reflective surface 11 of the optical element 8 is configured to reflect the beam of light 10 from the light source 9 so that it converges in the direction of the X axis and diverges in the direction of the Z axis, while the light 12 travels towards the skin, which may be in the direction of the Y axis. In this way, the elliptical beam 10 is elongated into a line projection 7, as desired. The reflective surface 11 is curved in the plane defined by axes X and Y, as shown in FIG. 2, and the curved profile is constant as the reflective surface 11 extends in the direction of the Z axis. The curvature of the reflective surface 11 in the X-Y plane causes the light beam 10 which is incident on the surface 11 to be reflected in a converging manner to the focal length 13, as shown in FIG. 2. The focal length 13 can be changed by changing the curvature in the X-Y plane of the reflective surface, depending on the size and configuration of the device to which the optical module is to be mounted.

As shown in FIGS. 3 and 4, the light source 9 is arranged to emit the elliptical beam 10 so that the major axis 14 of the elliptical beam 10 is aligned with the Z axis of the optical element 8. Therefore, the beam of light 10 from the light source 9 is divergent in the direction of the Z axis, both prior to and after the light has been reflected by the reflective surface 11. This will cause the reflected light 12 to be elongated in the direction of the Z axis at the same time as the reflected light 12 is focussed in the direction of the X axis, so that the light forms a line 7, as desired.

Therefore, the elliptical beam 10 emitted from the light source 9 is diverged and elongated in the direction of the major axis 14 of the ellipse and converged and focussed to the focal length 13 in the direction of the minor axis 15 of the ellipse.

Also shown in FIG. 4, the reflected light 12 exits the optical element 8 through a face 16 which is flat and parallel to the direction of the Z axis. Therefore, as the reflected light 12 exits the optical element 8 via the face 16, into air on the other side, the light 12 is refracted. The difference in refractive index between the material of the optical element 8 and the air around the optical device 6 causes any light which is not perpendicularly incident to the face 16 to change direction. As the reflected light 12 is already divergent in the direction of the Z axis, this refraction causes the light 12 to be further diverged and the optical line 7 is further elongated. The curvature of the reflective surface 11 should be adjusted to account for the refractive effects in the direction of the X axis in order to maintain the desired focal length 13 and direction.

As explained earlier, regulations apply to use of light on the skin and in the vicinity of eyes. Therefore, when using a diode to project an optical line onto the skin of a user it is important to consider the power and intensity of the light that interacts with the skin. Therefore, the intensity of the optical line needs to be defined such that the risk to users is eliminated and the device complies with safety regulations. Furthermore, the necessary performance criteria, including the length and visibility of the projected optical line, needs to be maintained.

The elliptical beam 10 emitted from the light source 9 will have variable intensity; the beam 10 will have higher intensity at the centre of the beam 10 and lower intensity towards the edges of the beam 10. However, to improve the performance of the optical device 6 the projected optical line 7 should have substantially even light intensity along the entire length of the line 7.

On one hand, if the projected line 7 had a higher intensity in the middle of the line, closest to the light source, then the visibility of other parts of the line is reduced. On the other hand, it may not be possible to increase the power of the light source to improve the visibility of the parts of the line further from the light source because this would also increase the intensity of the line close to the light source, which may breach the safety regulations.

However, if the projected line had a substantially constant light intensity along its length then the power of the light source can be set to generate the required visibility along the entire line without the risk of some areas having higher intensity than others and breaching the safety regulations.

The optical device 6 shown in FIGS. 1 to 4 is formed of an integrated light source 9 and optical element 8. This has the advantage that the performance of the components is fixed and the positions of the components can not be adjusted relative to each other. Therefore, the direction and intensity of the light emitted by the device is fixed and controllable, which is advantageous for ensuring that the optical safety regulations are satisfied. Furthermore, the use of the reflective surface 11 in the optical element 8 eliminates the need for a separate lens to focus the light. Use of a separate lens may result in a beam capable of damaging an eye or skin of the user, especially if the device becomes damaged or is mistreated.

Figure 5:
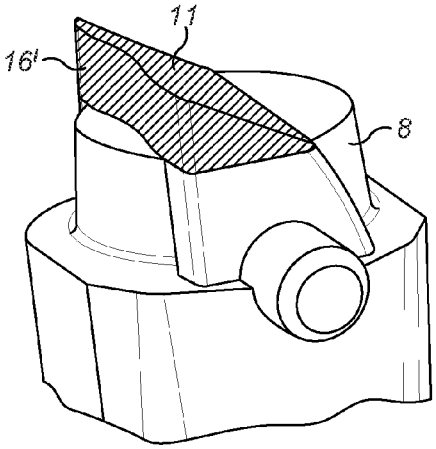
FIG. 5 shows a perspective view of an optical module according to an alternative embodiment of the invention and which additionally generates an image having a more uniform intensity.

FIG. 5 shows a modified embodiment of optical element 8 which is similar to that described with reference to FIGS. 1 to 4, but which additionally generates a line of more uniform intensity. In particular, FIG. 5 shows a modified face 16' through which the light exits the optical element 8. More specifically, the face 16' is shaped so that the light passing through the face is refracted so as to reduce the amount of light passing through a central region of the optical element and increase the amount of light passing through each of the end regions on either side of the central region. As can be seen from FIG. 5, the face 16' is formed with a concave shaped depression which causes varying amounts of refraction along the face 16' to fulfil this objective.

Figure 5A:
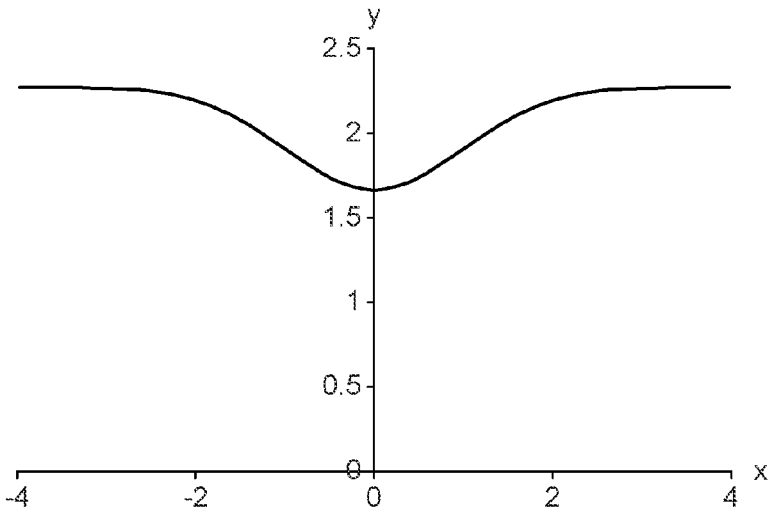
FIG. 5*a* shows a graph representing the shape of the surface through which light exits the optical element of FIG. 5.

The concave shaped depression on the face 16' may have a parabolic profile which may extend part-way or fully across the width of the face. FIG. 5*a* shows a representation of an example of the curvature of the face. In particular, FIG. 5*a* shows a graph in which the y axis represents the curvature of the face in the direction that the light passes through the face and the x axis represents the width of the face (Z direction, see FIG. 4).

Figure 6:
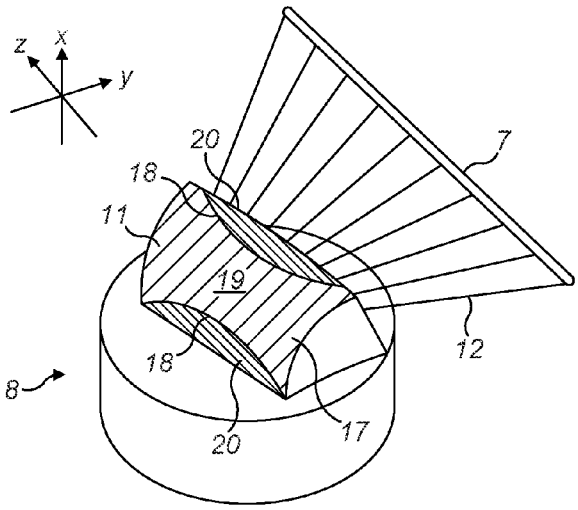
FIG. 6 shows a perspective view of an optical module according to another alternate embodiment of the invention, which also generates an image having a more uniform intensity.

In one example, the curvature of the concave depression in the face 16', as shown in FIGS. 5 and 5*a*, may be defined by the following equation:

$$y=1.567-0.61\times\cos(8x)\times\sqrt[5]{e^{-0.9272x^2}}$$

Where y is the distance from a fixed reference plane in the optical element to the face 16' in the direction that the light travels, and x is the distance across the face from the middle (in the direction of the Z axis shown in FIG. 6).

It will be appreciated that the definition of the curvature of the face 16' shown in FIG. 5*a* is merely an example of one configuration. The variables may be altered to change the shape of the face and give different resulting light projections. In this example, the shape defined above extends uniformly across the face 16'. However, it will be appreciated that the face may also have a curved profile in a place parallel to the defined curvature which may result in different light projections.

Figure 5B:
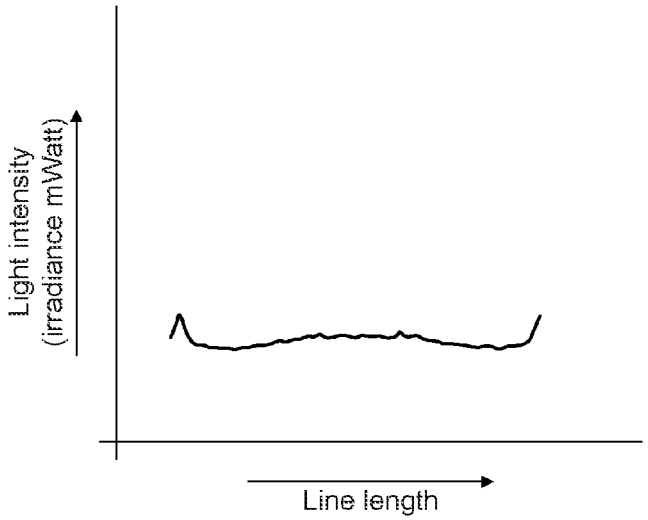
FIG. 5*b* shows a graph representing the relationship between light intensity and line length for the optical module shown in FIG. 5.

A graph showing the relationship of light intensity to line length is shown in FIG. 5*b*, from which it will be appreciated that the intensity of the light is substantially constant along its length due to the light being refracted by different amounts as it passes through the interface 16' between the optical element and the surrounding air.

The effect of the curved surface 16' shown in FIG. 5 is to create a substantially constant light intensity along the length of the projected line 7 so that the power of the light source 9 can be kept at the minimum value such that the entire projected line 7 only has the intensity necessary for the line to be visible and no more.

FIG. 6 shows another modified embodiment of optical element which is similar to that described with reference to FIGS. 1 to 4, but which also additionally generates a line of more uniform intensity. In particular, in FIG. 6, the reflective surface 11 is modified to further improve the intensity distribution along the elongate projected optical line 7.

As shown in FIG. 6, the reflective surface 11 has a reflective region 17 which is smaller in the middle of the reflective surface 11, closest to the light source 9, than at the edges. The two edges 18 of the reflective region 17, which extend in the same direction as the projected line 7, are curved. The curved edges 18 form a narrow waist region 19 and non-reflective, or absorptive, areas 20 are provided in the remaining space on the reflective surface 11. No light, or less light, is reflected by the absorptive areas 20 of the optical element. In this way, the reflective surface 11 of the optical element 8 is configured to reflect a higher proportion of the light incident at the ends of reflective region 17 than light which is incident in the central waist portion 19 of the reflective region 17. This has the effect of creating a line with a substantially even intensity distribution along the projected line 7. The intensity of the reflected light in the middle of the projected line 7 is reduced while the intensity at the ends of the line is maintained.

The effect of the reflective surface 11 shown in FIG. 6 is to create a substantially constant light intensity along the length of the projected line 7 so that the power of the light source 9 can be kept at the minimum value such that the entire projected line 7 only has the intensity necessary for the line 7 to be visible on the skin and no more.

The integrated optical module 6, comprising the optical element 8 and light source 9, has the advantage that all of the components are formed into one integral assembly which can be submitted for electrical safety tests as one unit. This is preferable over having separate components mounted adjacent to each other as this creates problems with mounting the components, sealing them and designing against degradation or damage.

Although the embodiments of the invention described with reference to FIGS. 1 to 6 are configured to project an optical line onto a user's skin, it will be appreciated that the light source and optical element may be adapted to generate and project a different, elongate shape. For example, by changing the shape of the reflective surface and/or the shape of the beam emitted from the light source, a variety of elongate shapes may be generated, such as a line which varies in thickness along its length, or that includes an arrow head or similar shape. Furthermore, the reflective region 17, exit face 16, 16' or another part of the optical element may have an alternative shape or include a filter such that the light exiting the optical module forms a different shape.

In another embodiment, the optical element 6 which projects an elongate optical image, such as a line, onto a user's skin, may be mounted to a moveable support which moves to alter the direction which the optical image is projected in. For example, the movable support may be able to rotate so that the optical image can be projected in different directions.

Figure 7:
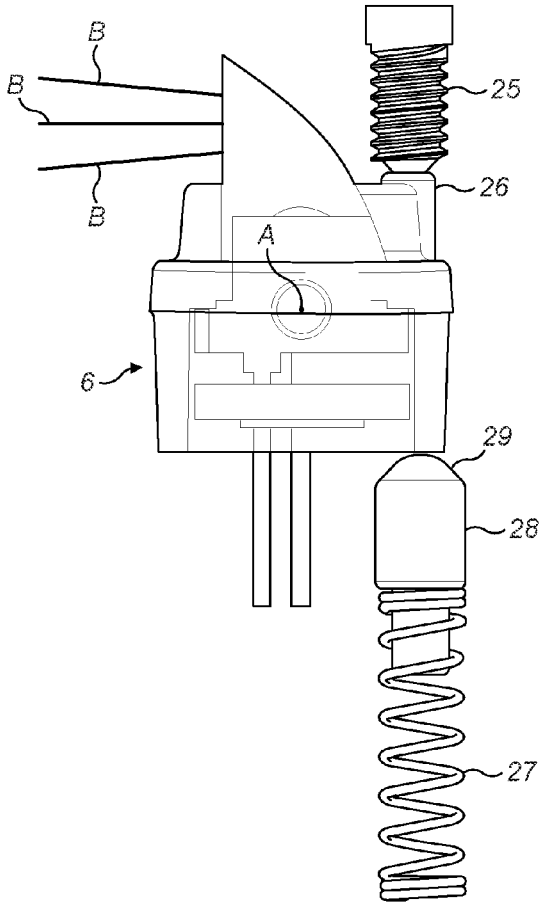
FIG. 7 shows an angle adjuster for the optical module according to any of the embodiments of the invention, which enables the optical module to be rotated about an axis relative to the device.
Figure 8:
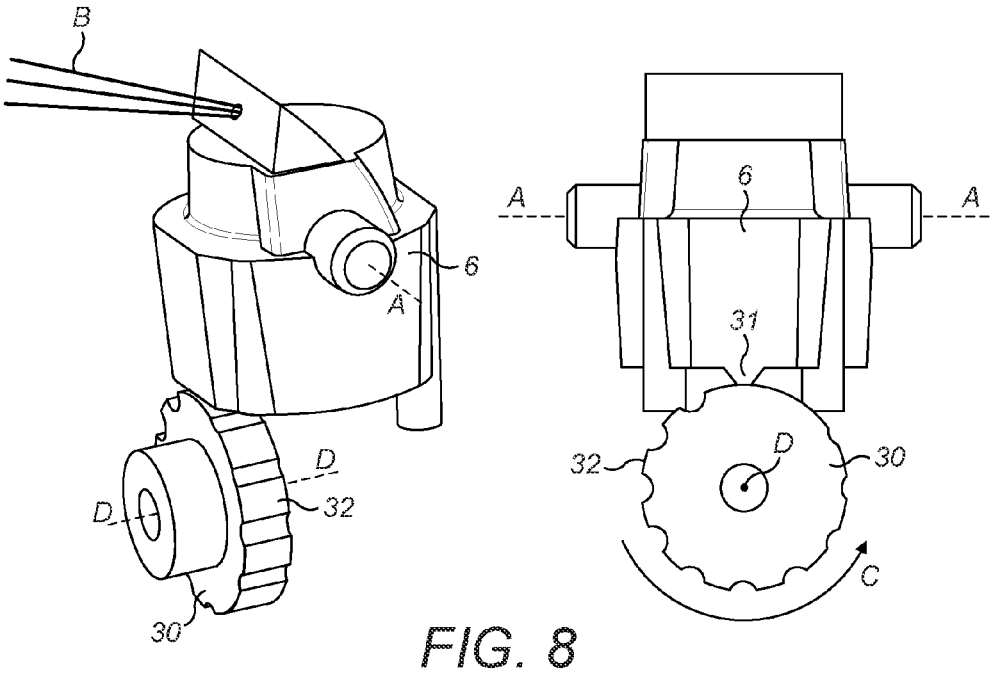
FIG. 8 also shows another type of angle adjuster for the optical module.

As shown in FIGS. 7 and 8, the optical module 6 may be mounted to the housing 3 so that it can rotate about a defined axis 'A' parallel to the cutting element 7 so that the angle of the beam 'B' may be altered to position it relative to the cutting elements 7.

Figure 9:
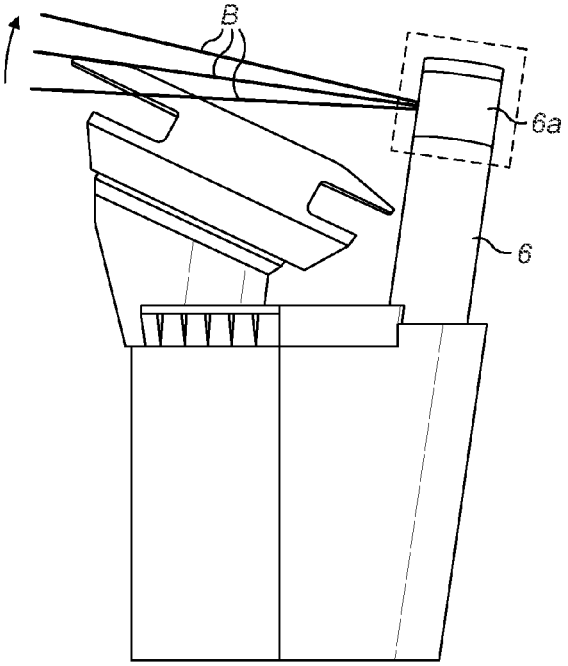
FIG. 9 shows a side elevation of the optical module mounted to the housing and illustrates how the angle adjuster can be used to change the angle of the optical image to move it closer to, or away from, the plane of the cutting elements.

FIG. 9 shows the location of the optical module 6 on the retractable arm 6*a* of the housing of the device, with arrows B representing the variation in angle of the light projection that can be achieved by rotating the optical module about axis A as described above (see FIGS. 7 and 8).

Also shown in FIG. 7, the device may comprise a step-less adjustment mechanism. The module 6 is mounted to the housing 3, or to the retractable shaft 6*a*, for rotation about axis "A". A threaded adjuster 25, such as a thumb-screw, bears against a surface 26 on an upper side of the optical module 6, which is biased into contact with the thumb-screw 25 by a spring element 27 and buffer 28 that bears against a lower surface 29 of the module 6. Rotation of the thumb-screw 25 causes the optical module 6 to rotate about its axis A, against the bias provided by the spring element 27 so as to change the angle of the beam "B" relative to the housing.

An alternate embodiment is shown in FIG. 8, in which the position of the optical module 6 can be adjusted incrementally by small, defined steps. In this embodiment, a rotation wheel 30 or cam wheel bears against a cam follower 31 on the optical module 6. The cam follower 31 is urged into contact with the cam wheel 30 by a spring element (not shown, but similar to the spring element illustrated in FIG. 7). The cam wheel 30 has a cam surface 32 with a series of troughs and peaks. By rotating the cam wheel (such as in the direction of arrow 'C') about its axis 'D', the optical module 6 will rotate about its axis A as the distance between the cam follower 32 and the axis D will change, thereby changing the angle of the beam relative to the housing, as illustrated by arrow "B" in FIG. 9.

Figure 10:
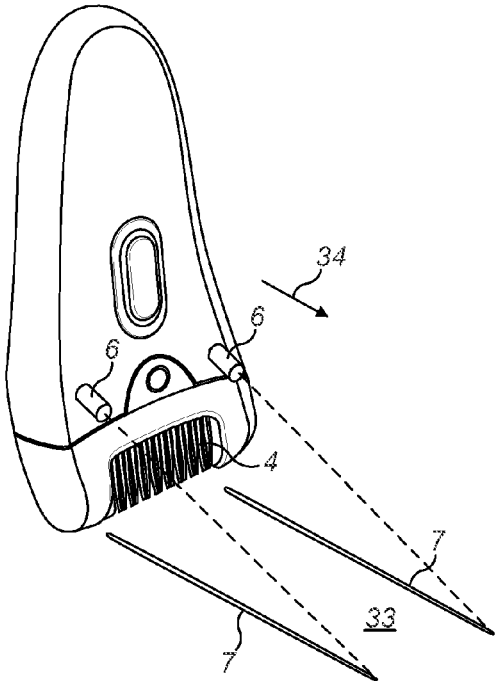
FIG. 10 shows a perspective view of a device for trimming hair having two optical modules, in accordance with other embodiments of the invention.
Figure 11:
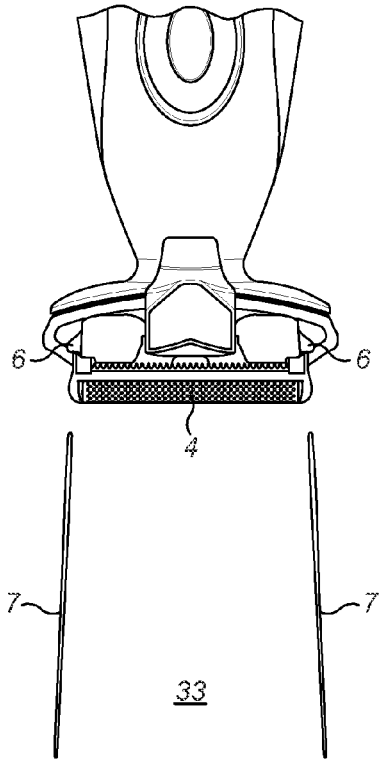
FIG. 11 shows a front view of a device for shaving hair having two optical modules, in accordance with yet other embodiments of the invention.

FIGS. 10 and 11 show an alternative embodiment of the device for cutting or trimming hair. In this case, the device has two optical modules 6 which project optical lines 7 onto the skin 33 of a user. The optical modules 6 are positioned on either side of the cutting blades 4 and are orientated to project optical lines 7 in a direction perpendicular to the blades 4 to demarcate the area of the skin that will be trimmed or shaved when the device is moved over the skin in the direction of operation, represented by arrow 34 in FIG. 10. In this way, the projected lines 7 inform the user of the direction in which the device is facing and the width of the cutting stroke, which may be useful during operation of the device.

The optical module adjustment mechanisms described with reference to FIGS. 7, 8 and 9 may be included in any embodiment with one or more optical modules and may be configured to allow individual or joint movement of the optical modules. For example, a single adjustment mechanism may be coupled to two optical modules to move them simultaneously in the same manner. Alternatively, each optical module may have an independent adjustment mechanism to allow the orientation of the individual projections.

It will be appreciated that the optical modules may be arranged in different formats to give different light projections. For example, the device may have an optical module that projects a line which is parallel to the cutting blades, as shown in FIG. 1*b*, and further optical modules that project lines which are perpendicular to the cutting blades, as shown in FIGS. 10 and 11.

It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A shaving or hair trimming device comprising an optical element for projecting an elongate optical image onto the skin of a user, said optical element comprising a reflective surface configured to reflect a beam of light emitted by a light source so that the beam of light converges in a first plane (X-Y) and diverges in a second plane (Y-Z), the first plane being at right angles to the second plane.

2. The device of claim 1, wherein said reflective surface is configured to cause the beam of light to converge in the first plane (X-Y).

3. The device of claim 2, wherein said reflective surface is curved in said first plane (X-Y) to cause the beam of light to converge.

4. The device of claim 3, wherein the reflective surface extends with constant curvature along second plane (Y-Z), from said first plane (X-Y).

5. The device of claim 1, wherein said reflective surface is configured to reflect an elliptical beam of light emitted by said light source and wherein a major axis of said elliptical beam of light extends in the same direction as the elongate image.

6. The device of claim 1, further comprising a light source integrally formed with the optical element and wherein the reflective surface is an internal surface of the optical element.

7. The device of claim 6, wherein the beam of light exits the optical element, towards the skin of a user, via a face of the optical element, said face being configured to refract the beam of light such that the beam of light diverges further in the second plane (Y-Z).

8. The device of claim 7, wherein said optical element comprises a concave depression in said face configured to refract the beam of light to deliver a more uniform light intensity distribution in the second plane (Y-Z).

9. The device of claim 1, wherein the reflective surface comprises a reflective portion and at least one absorptive portion configured to reflect a higher proportion of low intensity light which is incident on the reflective surface compared to high intensity light, such that the reflected light has a more uniform light intensity distribution in the second plane (Y-Z).

10. The device of claim 9, wherein the reflective portion has variable surface area, such that a higher proportion of light is reflected from a part of the reflective portion with larger surface area and a smaller proportion of light is reflected from a part of the reflective surface with smaller surface area.

11. The device of claim 1, wherein the elongate image is a line.

12. The device claim 1, comprising a light source integral with the optical element to form an optical module.

13. The device according to claim 1, comprising a housing having a handle, the optical element being retractable into the housing when not in use.

14. The device according to claim 1, comprising a cutting element and an adjuster to adjust the angle of the beam of light relative to the cutting element.

15. A method of projecting an elongate image onto the skin of a user in a shaving or hair trimming device comprising an optical element, said method comprising directing a beam of light emitted by a light source into said optical element such that the beam of light converges in a first plane (X-Y) and diverges in a second plane (Y-Z), the first plane being at right angles to the second plane.

* * * * *